US006094553A

United States Patent [19]

Shima

[11] Patent Number: 6,094,553

[45] Date of Patent: Jul. 25, 2000

[54] CLEANING MEMBER EMPLOYING FLEXIBLE BLADES AND BRUSHES FOR SURFACE OF DEVELOPER ROLLER

[75] Inventor: Kazuo Shima, Kashiwazaki, Japan

[73] Assignee: NEC Corporation, Japan

[21] Appl. No.: 09/324,935

[22] Filed: Jun. 3, 1999

[30] Foreign Application Priority Data

Jun. 8, 1998 [JP] Japan ..... 10-158806

[51] Int. Cl.[7] ..... G03G 15/10

[52] U.S. Cl. ..... 399/237; 399/238; 399/249

[58] Field of Search ..... 399/237–239, 399/249, 348; 15/256.5, 256.51, 256.52

[56] References Cited

U.S. PATENT DOCUMENTS

| | | | |
|---|---|---|---|
| 5,521,685 | 5/1996 | Barnes et al. | 399/249 |
| 5,737,673 | 4/1998 | Lang et al. | 399/249 |
| 5,893,012 | 4/1999 | Schubert et al. | 399/237 |

FOREIGN PATENT DOCUMENTS

| | | |
|---|---|---|
| 49-441 | 1/1974 | Japan . |
| 53-36345 | 6/1977 | Japan . |
| 56-70579 | 6/1981 | Japan . |
| 4-211276 | 8/1992 | Japan . |
| 5-289587 | 11/1993 | Japan . |
| 8-50416 | 2/1996 | Japan . |
| 9-258550 | 10/1997 | Japan . |
| 11-73028 | 3/1999 | Japan . |
| 11-231746 | 8/1999 | Japan . |
| 11-249444 | 9/1999 | Japan . |
| 11-282257 | 10/1999 | Japan . |

*Primary Examiner*—William J. Royer
*Attorney, Agent, or Firm*—Ostrolenk, Faber, Gerb & Soffen, LLP

[57] ABSTRACT

A cleaning member on a surface of a developer roller can effectively remove toner particles on the developer roller. The cleaning member has a plurality of flexible blades slidingly contacting with the surface of the developer roller on a peripheral surface of a rotary roller arranged in parallel to the developer roller and brushes provided on the surface of the roller at a position between the blades and slidingly contacting with the surface of the developer roller. The cleaning roller is housed within a cleaning chamber and driven to rotate at a higher speed than the developer roller.

7 Claims, 4 Drawing Sheets

CLEANING MEMBER EMPLOYING FLEXIBLE BLADES AND BRUSHES FOR SURFACE OF DEVELOPER ROLLER

BACKGROUND OF THE INVENTION

1. Field of the Invention

The present invention relates to a cleaning member for a surface of a developer roller, a developer utilizing the same and an image recording apparatus.

2. Description of the Related Art

In a wet type color electrophotographic printer, it is a significant problem to cause degradation of a printing quality due to accumulation of deposited toner particle on a developer roller.

Conventionally, as a cleaning member for a surface of the developer roller of the type, to which the present invention is directed, there is a cleaning member which depresses a material having large surface friction force, such as a porous body, a non-woven fabric and so forth onto the developer roller and performs cleaning with discharging a toner ink from in the porous body or so forth Japanese Unexamined Patent Publication No. Showa 56-70579). Also, as another cleaning member, there is a cleaning member which depresses a tip end of a thin plate form blade onto the developer roller to perform cleaning (Japanese Unexamined Patent Publication No. Heisei 9-258550).

However, the former cleaning member encounters a problem in that accumulation of toner particles held within void portions of the porous body to generate coagulated toner particles. Further a problem is encountered in that plugging of the void portions of the porous body is caused by the coagulated toner.

The later encounters a problem in causing deposition of the toner particles at the tip end of the thin plate form blade to cause coagulated toner particles.

Furthermore, due to physical property of the toner particles used in the toner ink, a problem is encountered in that the toner particles once coagulated cannot be dispersed into the toner ink again because it will cause degradation of the toner ink and lowering toner concentration at early timing.

SUMMARY OF THE INVENTION

It is an object of the present invention to provide a cleaning member for a surface of a developer roller, a developer utilizing the same and an image recording apparatus, which can effectively remove toner particles on the developer roller.

According to one aspect of the present invention, a cleaning member for a surface of a developer roller removing a toner deposited on the surface of the developer roller comprises:

a plurality of flexible blades slidingly contacting with the surface of the developer roller on a peripheral surface of a rotary roller arranged in parallel to the developer roller;

a brush provided on the surface of the roller at a position between the blades and slidingly contacting with the surface of the developer roller.

It is preferred that a projecting height of the blades from the peripheral surface of the roller is higher than a projecting height of the brush.

The blades may take the following form with respect to the roller:

$\hat{1}$ the blades extend in parallel to an axis of the roller over the entire length.

$\hat{2}$ the blades extend obliquely from an upstream side to a downstream side in a rotating direction with respect to the axis over the entire length of the roller.

$\hat{3}$ each blade extends in parallel to the axis of the roller over a length shorter than the length of the roller, and a plurality of blades are arranged in lattice fashion with spaced apart relationship in the axial direction and circumferential direction of the roller as a whole of the blades.

$\hat{4}$ each blade extends obliquely from an upstream side to a downstream side with respect to the axis of the roller over a length shorter than the length of the roller, and a plurality of blades are arranged in lattice fashion with spaced apart relationship in the axial direction and circumferential direction of the roller as a whole of the blades.

According to the second aspect of the present invention, a developer comprises:

a developer roller developing a latent image on a photosensitive body; and a cleaning member removing a toner deposited on the surface of the developer roller, the cleaning member including a plurality of flexible blades slidingly contacting with a surface of a developer roller and brushes slidingly contacting on the surface of the developer roller on the peripheral surface of the roller between the blades, the cleaning member being driven at higher rotation speed than the developer roller and being housed within a cleaning chamber.

According to the third aspect of the present invention, an image recording apparatus comprises:

a photosensitive body forming a latent image by charging and exposing means;

a developer developing the latent image on the photosensitive body by a developer roller;

transferring means for transferring a developed image on the photosensitive body onto a printing medium;

cleaning means for cleaning deposited toner on the photosensitive body after transfer;

fixing means for fixing the toner on the printing medium; and transporting means transporting the printing medium, the developer having a cleaning member for removing a toner deposited on the surface of the developer roller being housed within a cleaning chamber to rotate at a rotation speed higher than that of the developer roller, the cleaning member carrying a plurality of flexible blades slidingly contacting with the surface of the developer roller projecting from a rotary roller in parallel to the developer roller in spaced apart relationship in a circumferential direction of the developer roller, and brushes slidingly contact on the surface of the developer roller being provided on the peripheral surface of the roller between the blades.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
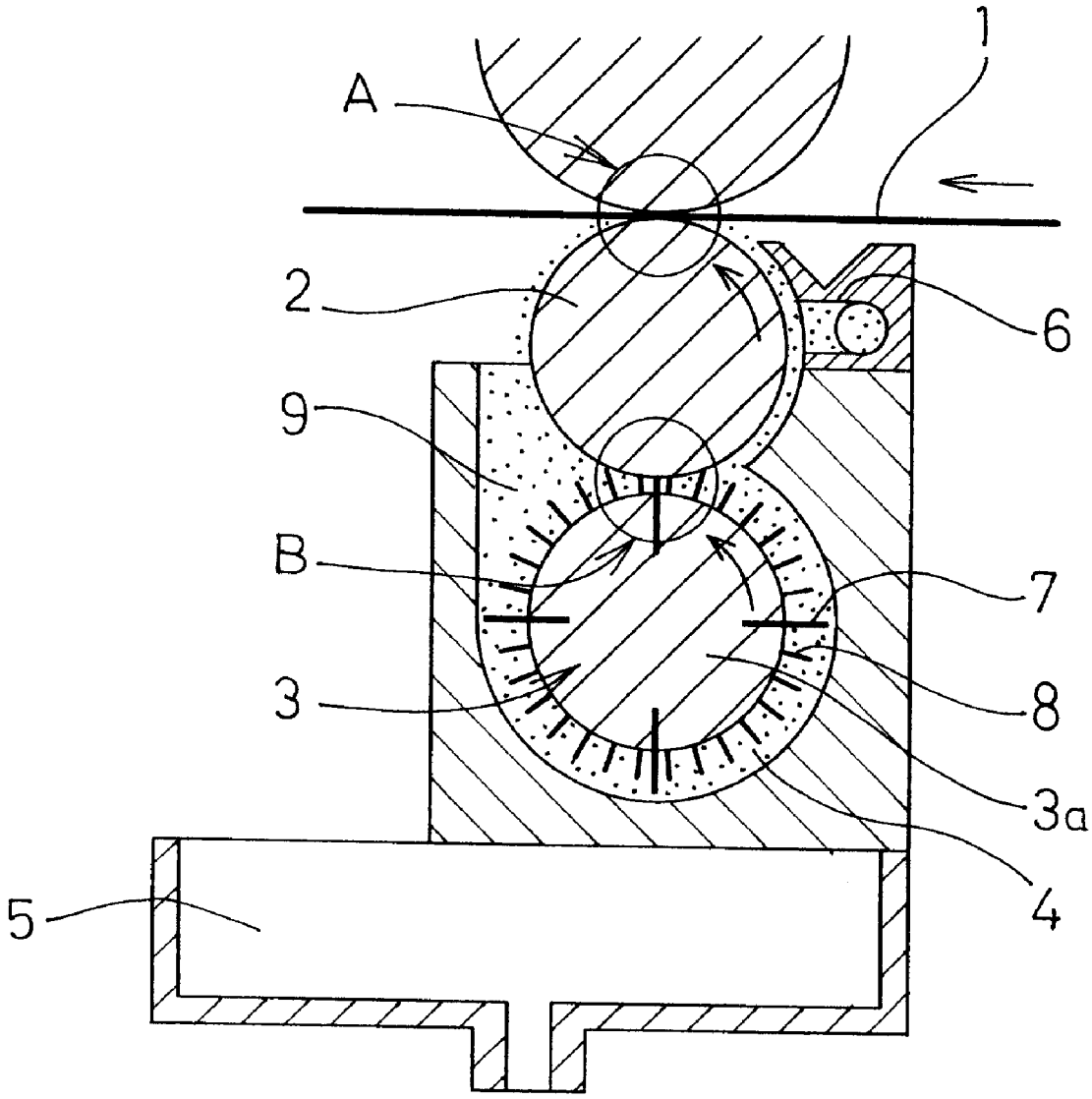
FIG. 1 is an illustration showing a construction of one embodiment of a developer according to the present invention.

FIG. 1 shows a general construction of one embodiment of a developer having a cleaning member in accordance with the present invention. The cleaning member 3 according to the invention is housed within a cleaning chamber 4 at a lower side of a developer roller 2 in order to hold within a toner ink 9. The developer roller 2 is made of a material having elastic characteristics, such as Viton rubber or the like.

The cleaning member 3 has a plurality of thin plate form flexible blades 7 formed of urethane rubber or the like on a peripheral surface of a cylindrical roller 3*a* having a length longer than the developer roller, brushes 8 formed of nylon or the like radially projecting and spaced apart in a circumferential direction of the cylindrical roller 3*a* at positions on the peripheral surface of the cylindrical roller 3*a* between the blades 7. Each blade 7 has a length longer than the developer roller 2. A projecting height of the blades 7 from the surface of the cylindrical roller 3*a* is set higher than a projecting height of the brushes 8.

The cleaning member 3 is driven to rotate in synchronism with driving of the developer roller 2 in the same direction as the developer roller at a higher rotation speed. While the cleaning member 3 is driven to rotate, the tip end portions of a plurality of blades 7 and tip ends of brushes 8 slidingly contact with the surface of the developer roller 2. Upon printing, a given bias voltage is applied to the developer roller 2. Furthermore, on the developer roller 2, a given concentration of the toner ink 9 is supplied from an ink supply opening 6. A photosensitive belt 1 formed with a latent image on a surface thereof is transported while maintaining a fine gap. The toner ink 9 is supplied into the gap.

Figure 2:
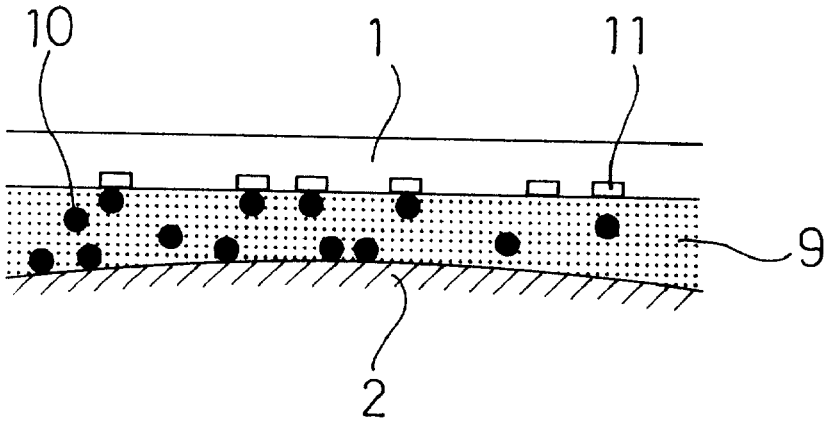
FIG. 2 is an enlarged illustration showing the detail of a portion A of a surface of one embodiment of a developer roller in FIG. 1.

FIG. 2 is an enlarged illustration showing detail of a portion encircled by a circle line A in FIG. 1. Referring to FIGS. 1 and 2, the surface of the photosensitive belt 1 is charged at a voltage having a potential higher than the bias voltage on the developer roller 2 and a latent image portion 11 formed on the belt 1 is charged at a voltage having a potential lower than the bias voltage on the developer roller 2. The toner ink supplied between the photosensitive belt 1 and the developer roller 2 is an ink, in which a toner particles 10 consisting of a charged coloring agent is dispersed within a petroleum solvent to perform desired printing by depositing only toner particles 10 in the toner ink 9 on the printing medium.

The toner ink 9 is supplied into the gap between the photosensitive belt 1 and the developer roller 2 at a given flow rate. The toner ink thus supplied is collected by an ink collecting portion 5 and is supplied to an ink supply opening 6 by a not shown pump or the like. On the photosensitive belt 1, the latent image pertion 11 having low potential is formed on the surface of the developer roller 2 adapting to the desired printing pattern so that the toner particles 10 are deposited onto the latent image portion 11 by electrophoresis of the toner particles 10 in the toner ink 9. However, other than the latent image portion 11 of the photosensitive belt 1, the surface of the photosensitive belt 1 is charged at a potential higher than the surface of the developer roller 2 to deposit the toner particles 10 in the toner ink 9 onto the developer roller 2.

Figure 3:
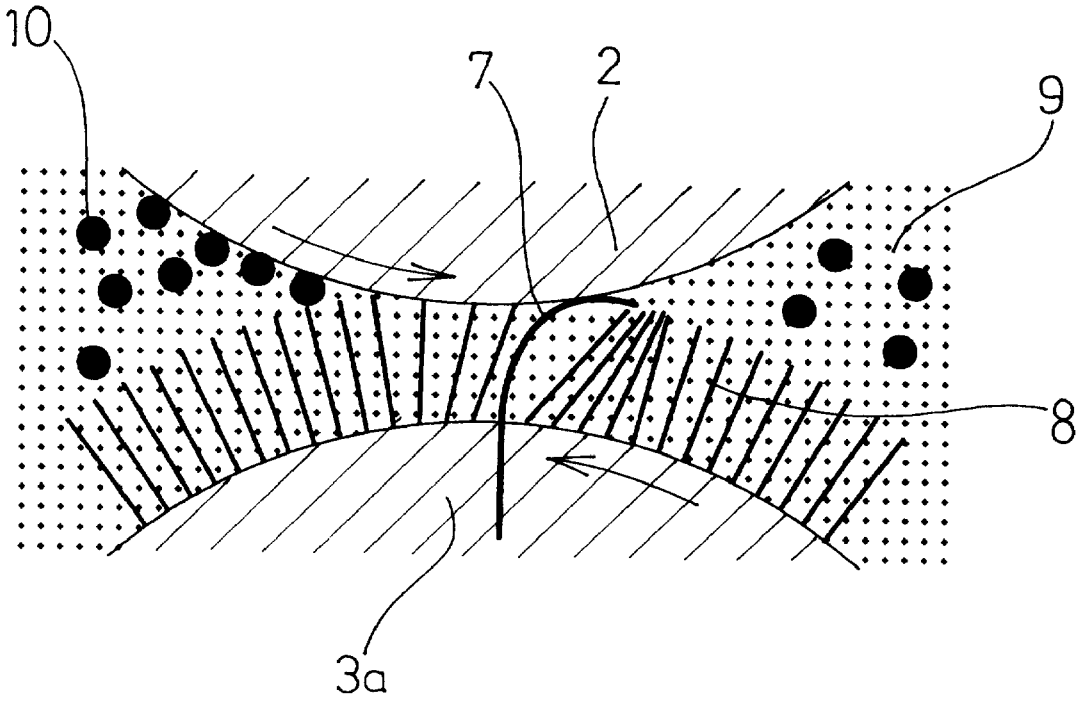
FIG. 3 is an enlarged illustration showing the detail of a portion B of a surface of one embodiment of a developer roller in FIG. 1.

FIG. 3 is an enlarged illustration showing a detail of a portion encircled by a circle line B in FIG. 1. Referring to FIGS. 1 and 3, the toner particle 10 deposited on the developer roller 2 is transferred to a cleaning portion according to rotation of the developer roller 2. Then, the tip end portions of the blades 7 of the cleaning member 3 rotating at a higher speed slidingly contact with the surface of the developer roller 2 in deflected condition. In conjunction therewith, tip ends of the brushes 8 slidingly contact with the surface of the developer roller 2. By two-way sliding contact of the blades 7 and the brushes 8, the toner on the developer roller 2 can be cleaned up clearly without causing irregularity. Furthermore, by rotating the cleaning member 3 in the toner ink 9 filled within the cleaning chamber 4, the toner particles 10 removed by the blades 7 and the brushes 8 is again dispersed into the toner ink 9 as being stirred by the blades 7 and the brushes 8 and the toner ink 9 in the cleaning chamber 4 is collected in the ink collecting portion 5.

Figure 4A:
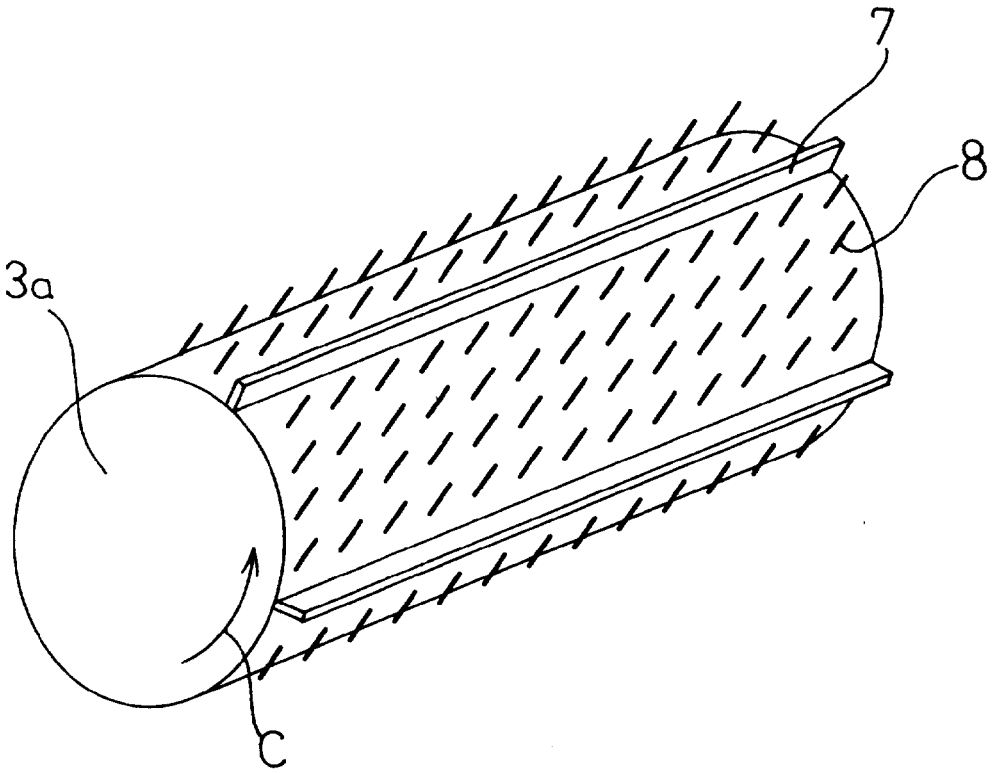
FIGS. 4A, 4B, 4C and 4D are illustrations showing an installation form of a blade and a brush in one embodiment of a cleaning member.
Figure 4B:
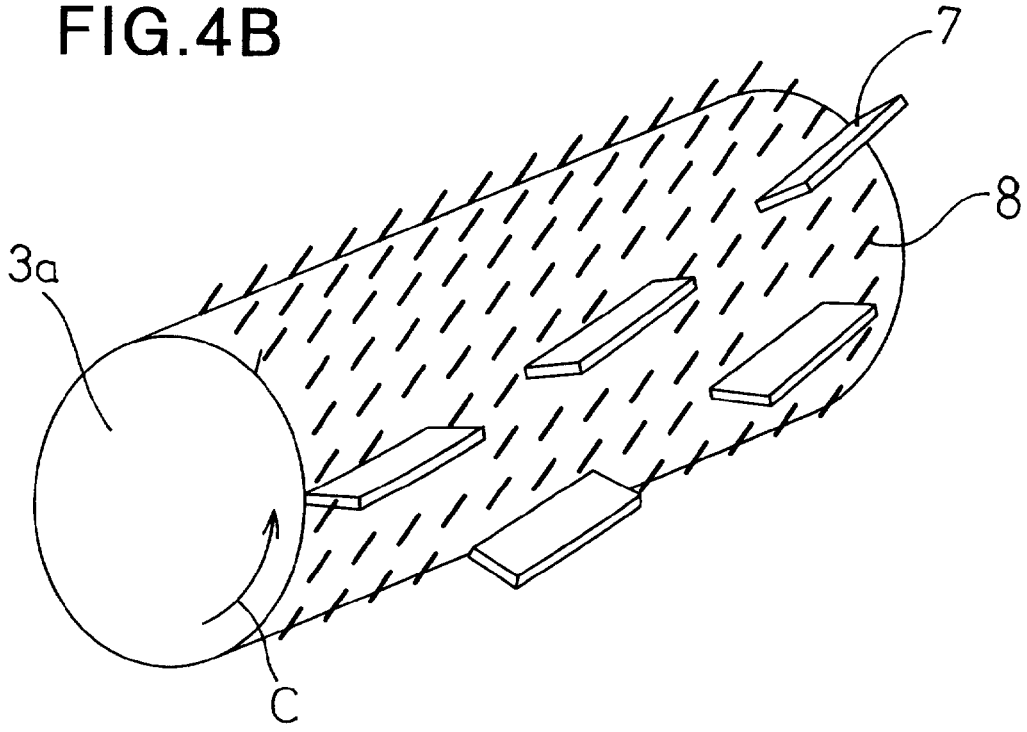
Figure 4C:
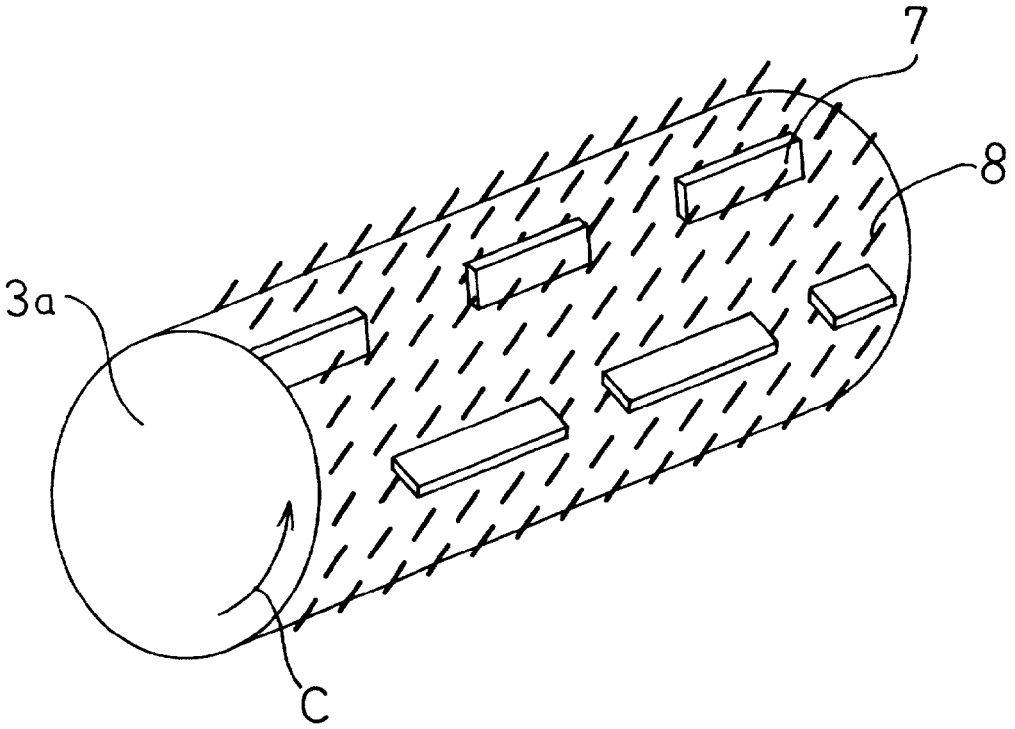
Figure 4D:
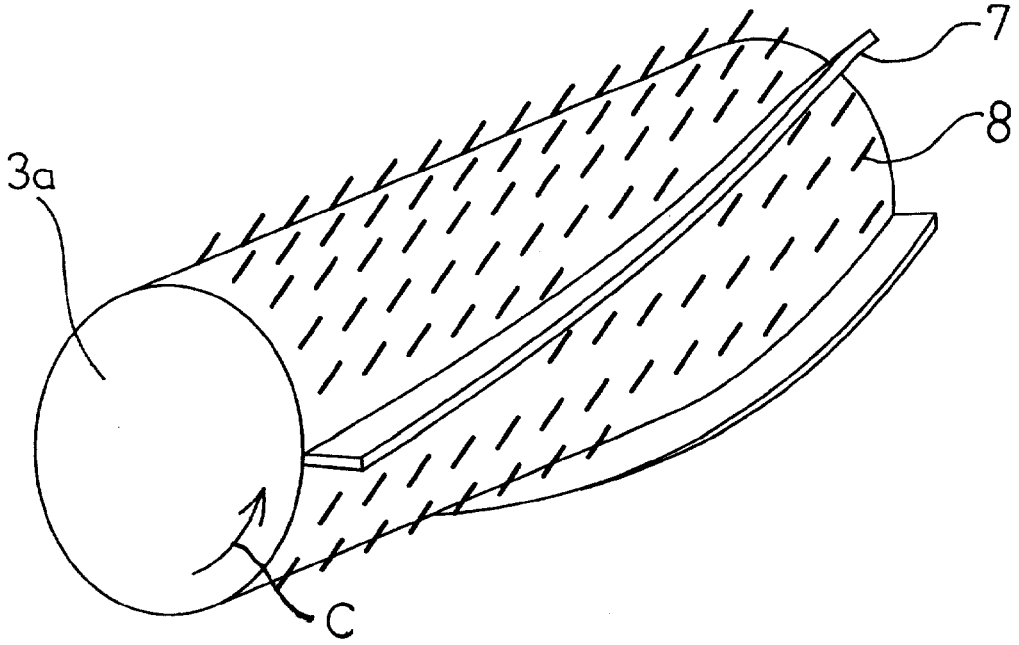

FIGS. 4A, 4B, 4C and 4D are illustrations showing arrangement forms of the blades 7 and the brushes 8 in the cleaning member 3. In FIG. 4A, respective of a plurality of blades 7 extend in parallel to an axis of the roller 3*a* over the entire length. In FIG. 4B, respective of a plurality of blades 7 extend oblique from an upstream side to a downstream side in the rotating direction C with respect to the axis over the entire length of the roller 3*a*. In FIG. 4C, each blade 7 extends obliquely from an upstream side to a downstream side in the rotating direction C with respect to the axis of the roller 3*a* in a length shorter than the length of the roller 3*a*. A plurality of blades 7 are arranged in lattice fashion spaced apart in the axial direction and circumferential direction. In FIG. 4D, each blade 7 extends obliquely from an upstream side to a downstream side in the rotating direction C with respect to the axis of the roller 3*a* in a length shorter than the length of the roller 3*a*. A plurality of blades 7 are arranged in lattice fashion spaced apart in the axial direction and circumferential direction. In the case of FIGS. 4B, 4C and 4D, since the toner ink 9 will not stay on the roller 3*a*, the toner ink 9 may easily flow.

The developer of the construction shown in FIG. 1 can be used in an image recording apparatus having transfer means for transferring a developed image on a photosensitive body onto a printing medium, cleaning means for cleaning deposited toner on the photosensitive body after transfer, fixing means for fixing the toner on the printing medium, and transporting means for transporting the printing medium.

As set forth above, by the cleaning member according to the present invention, since a plurality of blades and brushes on the peripheral surface of the roller are driven with sliding contact with the surface of the developer roller in two-ways to efficiently remove the toner particles on the developer roller. On the other hand, by driving the cleaning member to rotate at a higher speed than the developer roller within the cleaning chamber, deposition of the toner particle on the surfaces of the blades and the brushes can be successfully prevented. Also, by stirring with the blades and the brushes, the removed toner particles can be quickly re-dispersed into the toner ink.

Although the present invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the features set out in the appended claims.

What is claimed is:

1. A cleaning member for a surface of a developer roller removing a toner deposited on the surface of the developer roller comprising:

a plurality of flexible blades slidingly contacting with the surface of said developer roller on a peripheral surface of a rotary roller arranged in parallel to said developer roller;

brushes provided on the surface of said rotary roller at a position between said blades and slidingly contacting with the surface of said developer roller.

2. A cleaning member for a surface of a developer roller as set forth in claim 1, wherein a projecting height of each of said plurality of blades from the peripheral surface of the rotary roller is higher than a projecting height of said brushes.

3. A cleaning member for a surface of a developer roller as set forth in claim 1, wherein each of said plurality of blades extends in parallel to an axis of said rotary roller over the entire length.

4. A cleaning member for a surface of a developer roller as set forth in claim 1, wherein each of said plurality of blades extends obliquely from an upstream side to a downstream side in a rotating direction with respect to the axis over the entire length of the rotary roller.

5. A cleaning member for a surface of a developer roller as set forth in claim 1, wherein each of said plurality of blades extends in parallel to the axis of said rotary roller over a length shorter than the length of the rotary roller, and said plurality of blades are arranged in a lattice fashion with a spaced apart relationship in an axial direction and circumferential direction of the rotary roller as a whole of the blades.

6. A cleaning member for a surface of a developer roller as set forth in claim 1, wherein each of said plurality of blades extends obliquely from an upstream side to a downstream side with respect to the axis of said rotary roller over a length shorter than the length of the rotary roller, and said plurality of blades are arranged in a lattice fashion with a spaced apart relationship in an axial direction and circumferential direction of the rotary roller as a whole of the blades.

7. A developer comprising:

a developer roller developing a latent image on a photosensitive body; and a cleaning member removing a toner deposited on the surface of said developer roller, said cleaning member including a plurality of flexible blades slidingly contacting with a surface of the developer roller and brushes slidingly contacting on the surface of said developer roller on the peripheral surface of the cleaning member between said blades, said cleaning member being driven at higher rotational speed than said developer roller and being housed within a cleaning chamber.

* * * * *

UNITED STATES PATENT AND TRADEMARK OFFICE

CERTIFICATE OF CORRECTION

PATENT NO. : 6,094,553

DATED : July 25,2000

INVENTOR(S) : SHIMA

It is certified that error appears in the above-identified patent and that said Letters Patent is hereby corrected as shown below:

On the Title Page:

Item [54] the title should read as follows:

--CLEANING MEMBER EMPLOYING FLEXIBLE BLADES AND BRUSHES FOR SURFACE OF DEVELOPER ROLLER AND DEVELOPER USING THE SAME--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*